US007207091B2

(12) United States Patent
Dunaye

(10) Patent No.: US 7,207,091 B2
(45) Date of Patent: Apr. 24, 2007

(54) MAGNETIC CLASP APPARATUS

(76) Inventor: Gary Dunaye, 4027 Bancroft Dr., El Dorado Hills, CA (US) 95762

( * ) Notice: Subject to any disclaimer, the term of this patent is extended or adjusted under 35 U.S.C. 154(b) by 6 days.

(21) Appl. No.: 11/145,020

(22) Filed: Jun. 3, 2005

(65) Prior Publication Data

US 2005/0278903 A1 Dec. 22, 2005

Related U.S. Application Data

(60) Provisional application No. 60/577,426, filed on Jun. 4, 2004.

(51) Int. Cl.
*A44B 21/00* (2006.01)

(52) U.S. Cl. ..... 24/303

(58) Field of Classification Search ..... 24/303; 63/900, 3.1

See application file for complete search history.

(56) References Cited

U.S. PATENT DOCUMENTS 3,192,747 A * 7/1965 Stupell et al. ..... 24/303
4,231,137 A * 11/1980 Fujimoto ..... 24/303
5,050,276 A * 9/1991 Pemberton ..... 24/303
5,197,168 A * 3/1993 Levy ..... 24/303
5,572,887 A * 11/1996 Geswelli ..... 24/303
5,664,298 A * 9/1997 Nessar-Ivanovic ..... 24/303
5,806,346 A * 9/1998 Schlinger et al. ..... 24/303
6,401,726 B1 * 6/2002 Sonstegard ..... 132/275
6,598,272 B2 * 7/2003 Nire ..... 24/303
6,622,349 B2 * 9/2003 Wong ..... 24/303
6,981,391 B2 * 1/2006 Suzuki ..... 24/303
2004/0126621 A1 * 7/2004 Fukuda ..... 63/12

* cited by examiner

*Primary Examiner*—Robert J. Sandy
(74) *Attorney, Agent, or Firm*—John P. O'Banion

(57) ABSTRACT

A jewelry clasp with top and bottom sections, each section having a bore to receive a magnet, and each section having an interlocking surface on the perimeter of the bore. An eyelet is positioned on the perimeter of each section. The interlocking surfaces consist of mating camber protrusions that will lift and separate the top and bottom sections when the sections are rotated in one direction by the eyelets. One magnet is longer than the other to provide structural resistance to separation at the camber protrusions by opposing force exerted through the eyelets. In another embodiment, a steel tube is positioned in the bore of one section to encase the magnets to redirect magnetic flux and provide additional structural resistance against opposing force through the eyelets. Additional steel shielding can be used to reduce magnetic flux emanating from the clasp. Neodymium magnets coated with gold or silver are preferred.

34 Claims, 5 Drawing Sheets

MAGNETIC CLASP APPARATUS

CROSS-REFERENCE TO RELATED APPLICATIONS

This application claims priority from U.S. provisional application Ser. No. 60/577,426 filed on Jun. 4, 2004, incorporated herein by reference in its entirety.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

BACKGROUND OF THE INVENTION

1. Field of the Invention

This invention pertains generally to magnetic clasps for jewelry and the like, and more particularly to an improved magnetic clasp developed for the disabled or digitally challenged person. The present invention may generally be used in the bead and jewelry markets, but may also be advantageous for use with medical identification bracelets.

2. Description of Related Art

The majority of existing clasps for bracelet and necklace jewelry are mechanical and/or spring loaded and need the use of both hands and fine motor manipulation to couple or decouple the respective parts of a clasp. Magnetic clasps have been developed that allow the user to engage and disengage the clasp without fine motor manipulation. Most magnetic clasps use poor quality magnets and are designed to be pulled apart by applying opposing force through the eyelets. These clasps are easily disengaged accidentally because there is no structure to resist the opposing forces on the eyelets-just the magnetic force of the magnets. Accidental disengagement can result in loss or anxiety about loss. These existing magnetic clasps may also be bulky and heavy relative to the attached jewelry to have sufficient magnetic attraction to stay engaged. The magnetic flux generated by these existing clasps may restrict their use in some applications. What is needed is a quality magnetic jewelry clasp that can be engaged or disengaged with one hand but can resist accidental disengagement when opposing forces are exerted on the eyelets.

BRIEF SUMMARY OF THE INVENTION

A jewelry clasp consisting of top and bottom sections, each section having a bore to receive a magnet, and each section having an interlocking surface on the perimeter of the bore. An eyelet is positioned on the perimeter of each section. The interlocking surfaces consist of mating camber protrusions that will lift and separate the top and bottom sections when the sections are rotated in one direction by the eyelets. One magnet is longer than the other to provide structural resistance to separation at the camber protrusions by opposing force exerted through the eyelets.

In one embodiment, the sections have flattened surfaces to resist rolling and torsion on the clasp. There are three cambered protrusions oriented so that the top and bottom section can be manufactured from the same mold or cast.

In another embodiment, a steel tube is positioned in the bore of one section to encase the magnets to redirect magnetic flux and provide additional structural resistance against opposing force through the eyelets. Additional steel shielding can be used to reduce magnetic flux emanating from the clasp. In a preferred embodiment the clasps use neodymium magnets-the strongest magnets available.

The tube is designed to create a vertical chamber when the two magnets are together, and locks perpendicular to the horizontal force of the bracelet or necklace. The interlocking camber design also aids in the ease of removing the clasp sections.

A fairly large force is needed to overcome the attractive force of the magnets to separate the sections of the clasp. To this end a lifting or cambering action is used. By turning one of the clasp sections counterclockwise, the camber edge thus elevates against its mate, therefore separating the upper and lower magnets and consequently separating the top section from the bottom section. Because of the 90 degree end, or stop of each camber, a clockwise rotation is prevented. The overall effect is a controlled, even force upward, easily performed by anyone.

The interlocking camber design of the present invention prevents horizontal, vertical, and clockwise movement. The invention is easy to put on, easy to take off and fastens securely. In so far as most clasps are difficult to remove needing two hands and fine motor manipulation, the present invention can be unlocked with a simple counterclockwise twist and elevation. This maneuver can be done with one hand, if the individual pinches the two jump rings counterclockwise between the thumb and index or middle finger.

An embodiment of the invention is a clasp for securing two ends of an elongated item, the clasp comprises a first clasp member, the first clasp member having a first bore configured to receive a magnet, the first clasp member having a first interface surface circumscribing the first bore, a second clasp member, the second clasp member having a second bore configured to receive a magnet, the second clasp member having a second interface surface circumscribing the second bore, a first magnet positioned in the first bore and coupled to the first clasp member, where the second clasp member is configured to be magnetically attracted to the first magnet, where the first interface surface and the second interface surface have mating profiles, and where rotation of the first clasp member with respect to the second clasp member in a first direction decreases magnetic attractive forces between the first clasp member and the second clasp member and provides for separation of the clasp members.

An aspect of the invention is at least one eyelet coupled to an outer surface of the first clasp member, and at least one eyelet coupled to an outer surface of the second clasp member.

Another aspect of the invention is where the first interface surface includes one or more cambered protrusions, where the second interface surface includes one or more cambered protrusions, where the number of cambered protrusions on the first and second interface surfaces are identical, and where the position of the cambered protrusions in the first interface surface relative to the first eyelet is identical to the position of the cambered protrusions in the second interface surface relative to the second eyelet.

A further aspect of the invention is where the first interface surface includes at least one cambered protrusion that mates with a complementary recess in the second interface surface.

A still further aspect of the invention is where the first interface surface includes three cambered protrusions that mate with complementary recesses between three cambered protrusions in the second interface surface.

Another aspect of the invention is where the first and second interface surfaces include one or more stops configured to restrict rotation of the first clasp member with respect to the second clasp member.

A further aspect of the invention is where the first and second clasp members comprise a material having no magnetic properties.

A still further aspect of the invention is where the first and second clasp members comprise a material selected from the group consisting of gold, silver, copper, bronze, aluminum, stainless steel and precious metals.

Another aspect of the invention is where the first magnet has first and second ends, where the first magnet is positioned within the first bore and securedly attached at the first end to the first clasp member.

A further aspect of the invention is a second magnet having first and second ends, where the second magnet is positioned within the second bore and securedly attached at the first end to the second clasp member.

A still further aspect of the invention is where at least one of the magnets comprises a neodymium magnet.

Another aspect of the invention is where the first and second magnets are coated with a precious metal.

A further aspect of the invention is where the second end of the first magnet is positioned at or above the lowest point of the cambered protrusions on the first clasp member and the second end of the second magnet is positioned at or below the highest point of the cambered protrusions on the second clasp member.

A still further aspect of the invention is a tube securedly attached inside the bore of the first clasp member, the tube having an inside diameter slightly larger than the outside diameter of the first and second magnets, where the length of the tube is sized to encompass at least a portion of both first and second magnets when the first interface surface contacts the second interface surface.

Another aspect of the invention is where the tube comprises a material selected to redirect the magnetic flux toward a north-south polar axis of the first and second magnets.

A further aspect of the invention is a first disc coupled between the first clasp member and the first magnet, a second disc coupled between the second clasp member and the second magnet, where the first and second discs and the tube form a chamber enclosing the first and second magnets when the first and second clasp members are joined.

A still further aspect of the invention is where the first and second discs and the tube comprise steel.

Another aspect of the invention is where at least one of the magnets comprises a neodymium magnet.

Another embodiment of the invention is a clasp for securing two ends of an elongated item, where the clasp comprises a first clasp member having a first interface surface, a second clasp member having a second interface surface, means for magnetically securing the first clasp member to the second clasp member when the first interface surface is in contact with the second interface surface, and means for separating the first interface surface with respect to the second interface surface when the first member is rotated with respect to the second member, thereby releasing the means for magnetically securing the first clasp member to the second clasp member.

Another aspect of the invention is where the means for separating the first interface surface with respect to the second interface surface comprises at least one cambered protrusion on the first interface surface that mates with the same number of complementary recesses on the second interface surface.

A further aspect of the invention is where the means for magnetically securing comprises a first magnet having first and second ends, where the first magnet is securedly attached at the first end to the first clasp member, and a second magnet having first and second ends, where the second magnet is securedly attached at the first end to the second clasp member.

A still further aspect of the invention is where the first and second magnets are coated with gold or silver.

Another aspect of the invention is where the first and second discs and the tube comprise a material having magnetic properties.

A further embodiment of the invention is a clasp for securing two ends of an elongated item that comprises a first clasp member, the first clasp member having a first bore configured to receive a magnet, the first clasp member having a first interface surface circumscribing the first bore, a second clasp member, the second clasp member having a second bore configured to receive a magnet, the second clasp member having a second interface surface circumscribing the second bore, a first magnet positioned in the first bore and coupled to the first clasp member, a second magnet positioned in the second bore and coupled to the second clasp member, where the second magnet is configured to be magnetically attracted to the first magnet, where the first interface surface and the second interface surface have mating profiles, and where rotation of the first clasp member with respect to the second clasp member in a first direction decreases magnetic attractive forces between the first clasp member and the second clasp member and provides for separation of the clasp members.

A further aspect of the invention is where the first and second magnets are coated with gold or silver.

Another embodiment of the invention is a method of operating a clasp that includes two members, where the method comprises providing a first clasp member having a first magnet and a first interface surface, providing a second clasp member having a second magnet and a second interface surface that mates with the first interface surface, securing the first clasp member to the second clasp member by aligning the first magnet with the second magnet and contacting the first interface surface with the second interface surface, and releasing the first clasp member from the second clasp member by rotating the first clasp member with respect to the second clasp member in a first direction.

Another aspect of the invention is where rotating the first clasp member with respect to the second clasp member in the first direction separates the first clasp member relative to the second claps member to increase separation between the first and second magnets.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

Referring more specifically to the drawings, for illustrative purposes the present invention is embodied in the apparatus generally shown in FIG. 1 through FIG. 7. It will be appreciated that the apparatus may vary as to configuration and as to details of the parts, and that the method may vary as to the specific steps and sequence, without departing from the basic concepts as disclosed herein.

Figure 1:
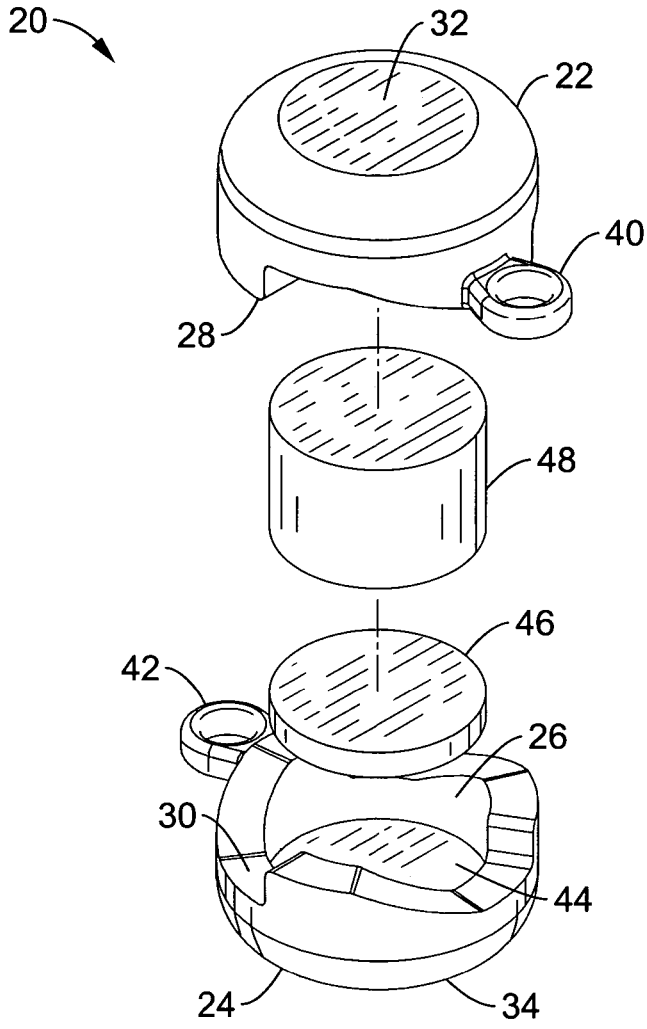
FIG. 1 illustrates an exploded perspective view of a clasp assembly of the present invention.

FIG. 1 illustrates an exploded perspective view of a clasp 20 in accordance with the present invention. Clasp 20 generally comprises a top section 22 and a bottom section 24 of a material with no magnetic properties, such as sterling silver, bronze, gold or other precious metal or jewelry metal alloy. Other materials such as aluminum, copper, stainless steel, ceramic or plastic may be suitably used in some applications. These materials may be plated or coated with a precious metal or jewelry metal alloy. Top and bottom sections 22, 24 are generally opposing cylinders having a bore 26 at the center of their opposing surfaces with interlocking surfaces 28 and 30 around the perimeter of the bore. These interlocking surfaces 28, 30 will be described further in FIG. 3 and FIG. 4.

In the embodiment shown in FIG. 1, top section 22, has outer flattened surface 32 and bottom section 24 has outer flattened surface 34 (hidden). Alternatively, these surfaces could be concave, spherical, contain inlaid patterns or gemstone settings. Top section 22 has top eyelet or jump ring 40, coupled on the outside and oriented horizontally. Bottom section 24 has bottom eyelet or jump ring 42, positioned generally 180 degrees from top eyelet 40 and oriented horizontally. Eyelets 40, 42 can also be oriented vertically or have elongated or multiple rings based on the jewelry style or preference.

Bottom section 24 is shown with a flat bottom 44 in bore 26. Lower magnet 46 is cylindrical in shape and adapted to fit inside bore 26 and to be secured by adhesive bonding to flat bottom 44. Correspondingly, an upper magnet 48 is adapted to be secured in the corresponding bore in top section 22 and mate with lower magnet 46. Placing the upper section 22 over the lower section 24, the magnetic attraction is perpendicular to the horizontal pull of the jump rings 40, 42. Lower and upper magnets 46, 48 may be charged with opposite polarities so that top, bottom sections 22, 24 are attracted to each other by the magnets, once in close proximity. The attractive force of the aligned magnets hold the two sections together.

Interlocking surfaces 28, 30 will interlock when magnets 46, 48 are aligned and mated.

In a preferred embodiment, when seated in the bore of bottom section 24, lower magnet 46 does not extend above the lowest portion of interlocking surface 30. Upper magnet 48 seated in the bore of top section 22 extends to or past the tallest portion of interlocking surface 28. This is accomplished by using different height magnets or different depth bores. When mated, the sides of the longer, upper magnet 48 provides structural resistance to horizontal separation of interlocking surfaces 28, 30 when opposing force is exerted through eyelets 40, 42.

In another embodiment of the invention, iron, steel or an iron alloy that is attracted magnetically to the other magnet is substituted for either lower or upper magnet 46, 48. In a further embodiment (not shown), lower magnet 46 is removed and bottom section 24 is made of a material that is attracted to upper magnet 48, such as steel.

In a preferred embodiment, lower, upper magnets 46, 48 are made from neodymium and exhibit a strong magnetic flux up to about 15,000 Gauss. A typical jewelry grade neodymium magnet may be rated at about 35 grade. In the present invention, about a 48 grade up to about a 60 grade magnet is preferred. When these higher grade magnets are used, the primary method of separating the clasp will be rotating the cambers as it will be extremely difficult to pull the aligned magnets apart. In an exemplary embodiment, the neodymium magnets are plated with gold or silver to prevent corrosion and to help shield the magnetic flux emanating from the magnets. Precious metals and/or noble metals such as gold and silver are preferred as a coating because they do not typically cause an allergic reaction when exposed to the skin. Other common coatings, such as nickel, can cause an allergic reaction or skin rash. Neodymium alloy, left uncoated, is subject to corrosion.

Top and bottom sections 22, 24 are preferably made of a material without magnetic properties that can absorb or shield the magnetic flux from the magnets. In one embodiment, top, bottom sections 22, 24 are made of sterling silver. In a further variation, the sterling silver is plated with 22k or 24k gold. In another embodiment, top, bottom sections 22, 24 are made of bronze. In one variation, the bronze is plated with 22k or 24k gold. In another variation, the bronze has a 200 mill silver plate. Precious metals are preferred as a coating because they do not typically cause an allergic reaction when exposed to the skin. The non-magnetic material in top, bottom section 22, 24 also prevents the clasp from opening or deactivating when a metal item with magnetic properties is adjacent to the clasp.

When lower, upper magnets 46, 48 are plated with a precious metal or noble metal and top, bottom sections 22, 24 are made from a material with non magnetic properties, the magnetic flux emanating from the clasp is about 5.2 Gauss measured at about a one inch distance. This measured magnetic flux is well below 90 Gauss, which is the generally accepted level of magnetic flux that can interfere with the safe operation of a pacemaker, implanted cardiac defibulator or other implantable medical device. Note that a one inch measurement is used because most implanted medical devices are positioned with at least one inch of muscle, tissue and/or skin between the device and the surface of the skin. The low magnetic flux emanating from clasp 20 allows it to be used safely to secure medical identification bracelets to patients and to be used in medical environments such as clinics and hospitals.

Figure 2:
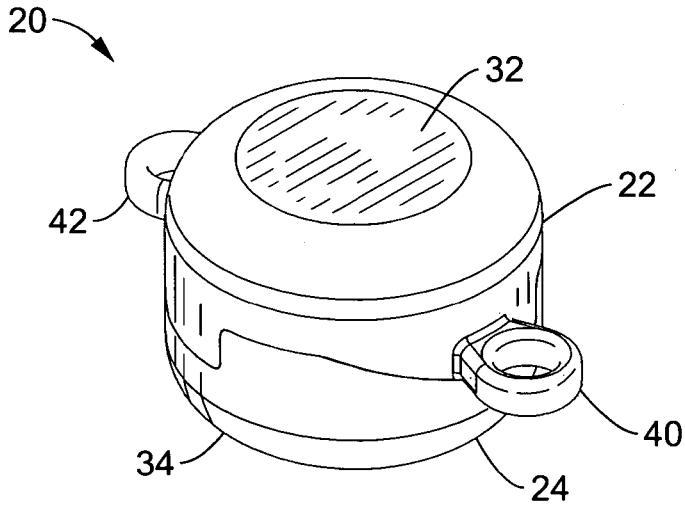
FIG. 2 illustrates a perspective view of the clasp assembly shown in FIG. 1 in a locked configuration.

FIG. 2 is a perspective view of clasp 20 shown in FIG. 1 in its assembled and locked configuration. Clasp 20 is round in appearance with a flattened top surface 32 and bottom surface 34 (not shown). The flattened surfaces 32, 24 of the clasp reduces rolling, when attached to a bracelet or jewelry piece, which lessens the torsion on jump rings 40, 42.

Figure 3:
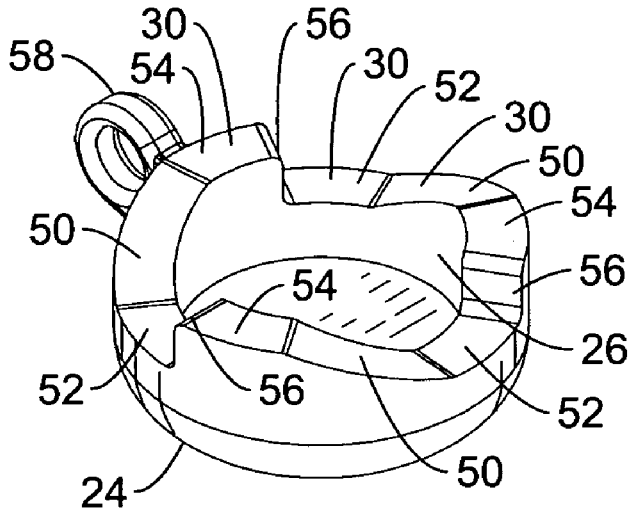
FIG. 3 illustrates a detailed perspective view of the bottom section of the clasp of the present invention shown in FIG. 1.
Figure 4:
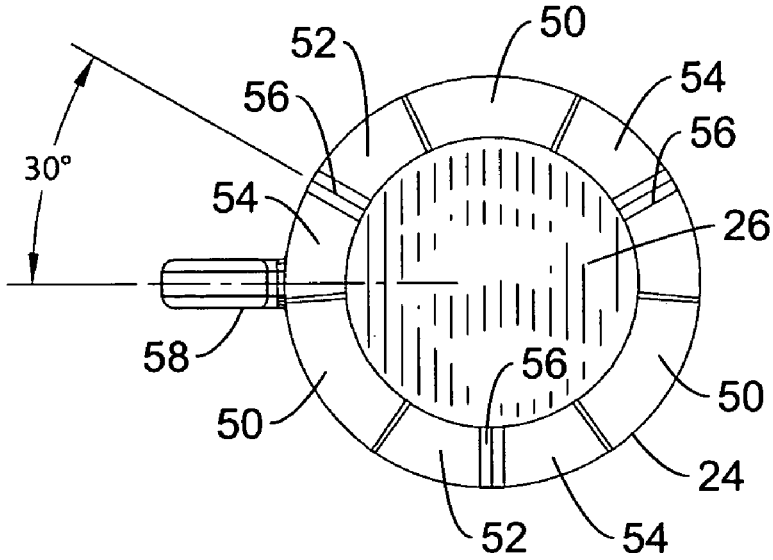
FIG. 4 illustrates a top view of the bottom section of the clasp shown in FIG. 3.

Now referring to FIG. 3 and FIG. 4, bottom section 24 of clasp 20 shown in FIG. 1 is illustrated to better describe mating surface 30. Mating surface 30 has three triangulated protrusions made of cambers 50 positioned equidistant around the circumference of bore 26. It will be appreciated that any number of cambers may be used to form the mating surfaces. Proceeding in a clockwise fashion around the bore 26, each camber 50 is generally a curved ramp that emanates from a bottom flat 52 and terminates at a top flat 54. The side of each top flat 54 drops, preferably at a 90 degree angle, to form a vertical stop 56, which then terminates at the start of the next bottom flat 52. The transition surfaces from camber 50 to top flat 54 to stop 56 are typically radiused for smooth sliding. In the illustrated embodiment, eyelet 58 is oriented vertically with respect to bottom section 24.

In one embodiment of the invention, bottom section 24 is about 8 mm in diameter with a bore of about 5 mm diameter. Each camber 50 is about 50 degrees of the circumference, each top flat 54 about 35 degrees, and each bottom flat 52 about 35 degrees. The angle of camber 50 is about 44 degrees from vertical. The depth of stop 56 from top flat 54 to bottom flat 52 is about 1.27 mm. Bore 26 is about 2.64 mm deep measured from top flat 54. The bottom thickness of bottom section 24 at the bore is about 1.25 mm. The outside radiused edge between the side and bottom of bottom section 24 has a radius of about 1.60 mm.

In a preferred embodiment, eyelet 58 is positioned about 29 to about 30 degrees from the face of the closest stop 56. The width of eyelet 58 is about 1 mm and the bottom edge is sloped upward from the vertical at about 74 degrees. Eyelet 58 has an inner diameter of about 1.5 mm and an outer radius of about 1.25 mm. The edge of eyelet 58 is beveled about 0.064 mm and the body of eyelet 58 that connects to bottom section 24 tapers inward from the eyelet at about 30 degrees.

As shown in FIG. 1, top section 22 preferably has a corresponding interfacing surface 28 with an equal number of mating triangular cambers such that the protrusions of bottom section 24 interlock between the protrusions of top section 22. The camber surfaces 50 mate and will slide to separate the two sections of the clasp when rotated in a first direction whereas the stop surfaces 56 of the triangulated cambers mate and resist rotation in a second direction. In a preferred embodiment, the profile and positioning of interfacing surfaces 30 of top bottom sections 22, 24 relative to the eyelets are identical to reduce cost of manufacture.

The majority of existing art clasps need the use of both hands to fasten together the respective parts of a clasps. A significant advantage of the present invention is that it can be fastened or unfastened using one hand. Because of the ease of magnetic attraction, the present invention can be used by disabled individuals who previously had difficulty or were unable to fasten a clasp when attempting to wear an item of jewelry such as a bracelet or necklace. To fasten, one only needs to bring top section 22 in close proximity to bottom section 24. Polarity will align the respective surfaces of the magnets and the interlocking surfaces 28, 30 will align and mate to close the clasp.

The interlocking camber design also aids in the ease of removing the clasp sections. A rotating action is used to overcome the strong perpendicular force of the magnets to disengage the clasps. By turning one of the clasp sections counterclockwise, the camber ramps 50 thus elevate, therefore separating the upper and lower magnets and consequently separating the top section 22 from the bottom section 24. Because of the 90 degree end, or stop 56 of each camber, a clockwise rotation is prevented. The overall effect is a controlled, even force upward, easily performed by anyone.

In so far as most jewelry clasps are difficult to remove needing two hands and fine motor manipulation, the present invention can be unlocked with a simple counterclockwise twist and elevation. This maneuver can be done with one hand, if the individual pinches the clasp counterclockwise with the index finger on one eyelet, the middle finger on the other eyelet and the thumb positioned on the seam between the sections. Once the sections are elevated apart, further pinching or rolling between the fingers and thumb will move the separated sections farther apart and easily overcome the remaining magnetic attraction.

Referring back to FIG. 1, in an exemplary configuration of the present invention, clasp 20, when closed, measures about 6.5 mm in height and about 8 mm in diameter. With eyelets on both sides, the clasp has a length of about 13 mm up to about 20 mm. The top section 22 has a 5 mm diameter central bore with about a 2.64 mm depth measured from the top of the bore. Attached at the bottom of the bore of top section 22 is upper magnet 48, preferably a coated neodymium magnet. The magnet is about 5 mm in diameter with a length of about 3 mm. When placed in the bore, upper magnet 40 extends to a position equivalent to or just past the top flat of interlocking surface 28. The bottom section bore 26 is about 2.64 mm in depth and about 5 mm in diameter. The central bore in the lower section accommodates the lower magnet 46 along with adhesions. The lower magnet 46 in the bottom section 24 is about 1 mm in height with about a 5 mm diameter. When placed in the bore, lower magnet 46 extends to about or just below the height of lower flat 52 on interlocking surface 30. Top, bottom sections 22, 24 are attracted by the magnetic north-south orientation of magnets 46, 48, and when they align they quickly lock together.

When the two sections are locked together, using about 48 grade magnets, the force required to separate the two sections on a horizontal plane is about five (5) pounds. The magnetic attraction perpendicular to the eyelets along with the longer upper magnet 48 overlapping the triangular cambering prevents the clasp from accidentally opening from horizontal shear force. Higher grade magnets require greater force for horizontal separation.

In addition to jewelry, clasp 20 can be used to temporarily secure small lightweight items such as identification tags, key rings, cord ends, etc.

Figure 5:
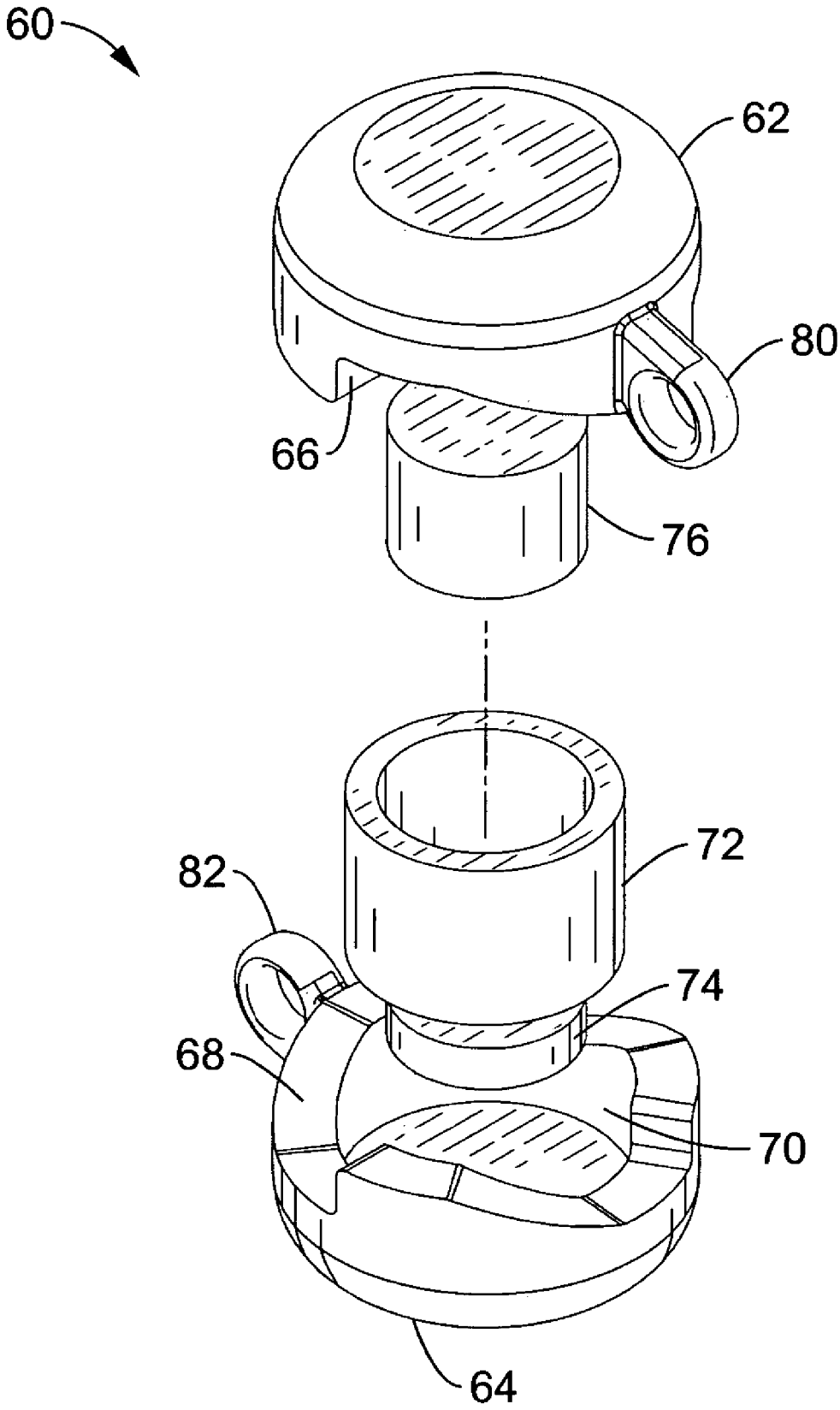
FIG. 5 shows an exploded perspective view of another embodiment of a clasp assembly with a tube enclosing the magnets.

FIG. 5 illustrates another embodiment of the invention configured with a tube enclosing the magnets. Clasp 60 consists generally of top section 62 and bottom section 64. Top section 62 has interlocking surface 66 and bottom section 64 has corresponding interlocking surface 68. A center bore 70, shown in bottom section 64 accommodates an elongated sleeve or tube 72. A bore in upper section 62 (not shown) also accommodates tube 72. Tube 72 forms a cylindrical chamber for lower magnet 74 and upper magnet 76. Upper section 62 is shown with a vertical eyelet 80 and bottom section 64 is shown with a corresponding vertical eyelet 82.

In one variation, tube 72 and lower magnet 74 are attached to the bottom of bore 70 in bottom section 64 and upper magnet 76 is attached to the center of the bore in top section 62. By enclosing the magnets in tube 72, and inserting tube 72 in the bores of top, bottom section 62, 64, structural resistance to horizontal shearing forces on opposing eyelets is greatly improved. In another variation, tube 72 and upper magnet 76 can be attached in the bore in upper section 62.

If tube 72 has magnetic properties such as steel, it also serves to increase the attractive force between the magnets by redirecting the horizontal magnetic flux or spray in a north-south polar direction. If tube 72 is non magnetic, such as bronze, it will shield the magnetic flux emanating from the magnets. Tube 72 can also be coated or plated with a precious metal or jewelry metal alloy. Clasp 60 is engaged and disengaged in the same manner as described previously in FIG. 3 and FIG. 4.

In an exemplary configuration of the present invention, clasp 60, when closed, measures about 6.5 mm in height and about 8 mm in diameter. With eyelets on both sides, the clasp has a length of about 13 mm to about 20 mm.

The top section 62 has about a 5 mm diameter central bore with about a 1 mm depth. Situated on the bottom of the bore is upper magnet 76, preferably a neodymium magnet. The magnet is about 4 mm in diameter with a length of about 3 mm.

The bore 70 of bottom section 64 is about 3 mm in depth and about 5 mm in diameter. Also situated on the bottom of the central bore 70 is a steel tube 72 having a height of about 4 mm, leaving approximately 3 mm for the upper magnet 76 of the top section 62. The inner diameter of the tube 72 is about 4.10 mm to accommodate the outer diameters of the magnets 74, 76. The slightly larger diameter allows the interior of the tube to receive upper magnet 76 of the top section 62. The outer diameter of tube 72 is about 4.90 mm, which is slightly smaller than the bore diameter in the top and bottom sections. Lower magnet 74 and tube 72 are adhered to the bottom of bore 70 to prevent loosening. Upper magnet 76 is secured in the center of the bore in top section 62 by adhesion. The lower magnet 74 in the bottom section 64 is 1 mm in height with a 4 mm diameter. The annular area surrounding upper magnet 76 in the bore allows tube 72 of the lower section 64 to slide past upper magnet 76 in the top section 62. The two sections are attracted by the respective north-south poles of the magnets, and when their interlocking surfaces touch, the triangular cambers align until they are locked together.

In an alternative embodiment, a 4 mm diameter by 1.5 mm length magnet is placed in the bottom of the tube and adhered to the bottom section. The top section has a mating 4 mm diameter by 2.5 mm length magnet. It is to be understood that other combinations of magnet lengths may be used without departing from the teachings of this invention.

Figure 6:
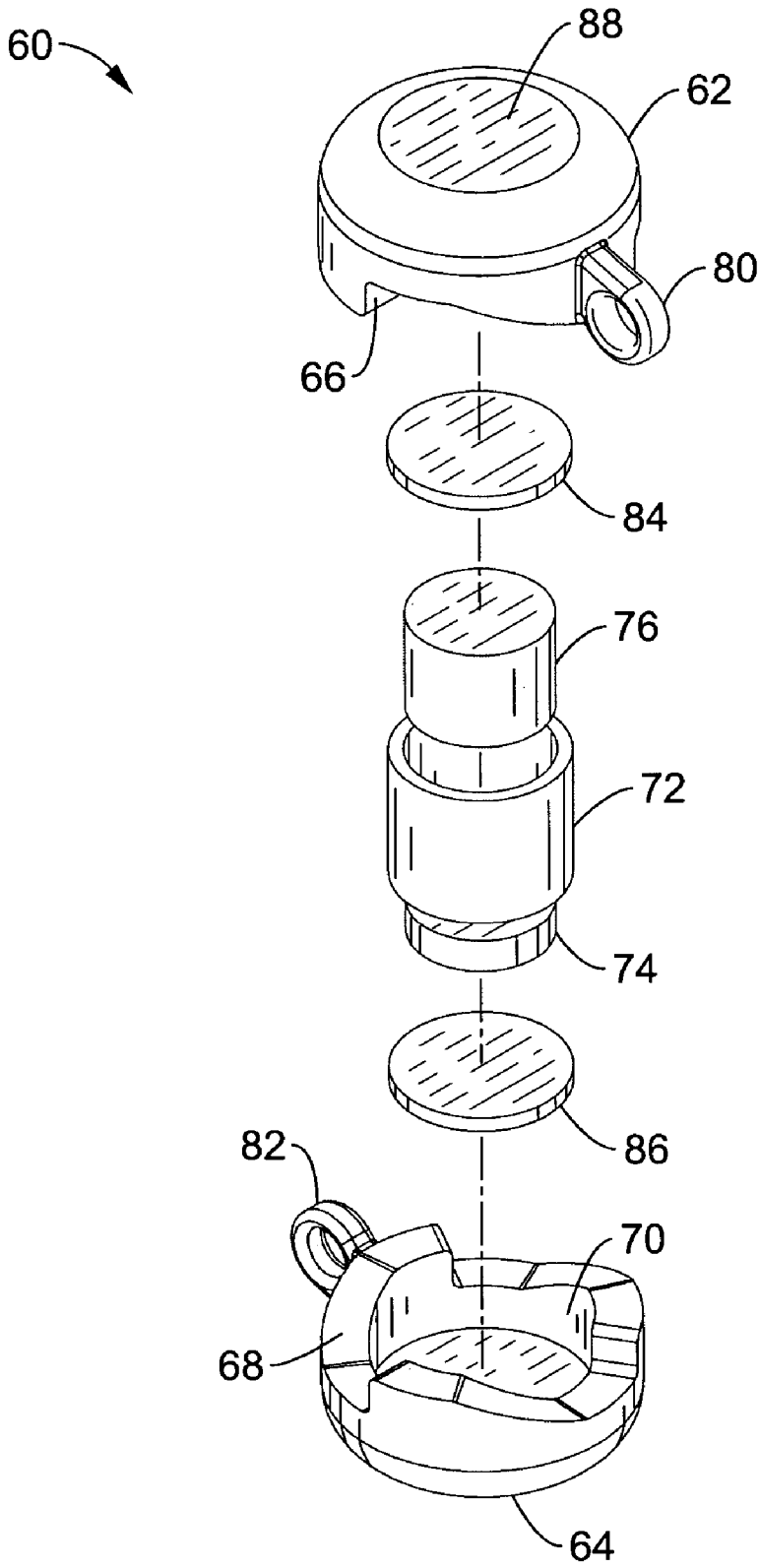
FIG. 6 shows an exploded perspective view of a further embodiment of a clasp assembly as shown in FIG. 5 with steel plates attached to the magnets in the top and bottom sections.

FIG. 6 illustrates a perspective exploded view of another embodiment of clasp 60 shown in FIG. 5 with top plate 84 positioned in the bore of top section 62 and bottom plate 86 positioned in bore 70 of bottom section 64. The diameter of top, bottom plates 84, 86 are about equal to the outer diameter of tube 72 and are attached at the bottom of the bores in top, bottom sections 62, 64 respectively. Upper magnet 76 is attached to top plate 84 and lower magnet 74 is attached to bottom plate 86.

Top, bottom plates 84, 86 combine with tube 72 to form a chamber that completely encloses magnets 74, 76 when the clasp is closed. This closed chamber significantly reduces the magnetic flux emanating from the closed clasp. In an exemplary embodiment, tube 72 and top, bottom plates 84, 86 are made of a material with magnetic properties such as steel.

Some pacemakers, implanted cardiac defibrillators and other implanted medical equipment can be disrupted by magnetic fields of about 90 Gauss or stronger. The closed chamber encapsulates the magnets and reduces the resultant magnetic flux significantly below this level so the clasp can be safely used in proximity of this sensitive equipment, such as for medical identification bracelets.

Figure 7:
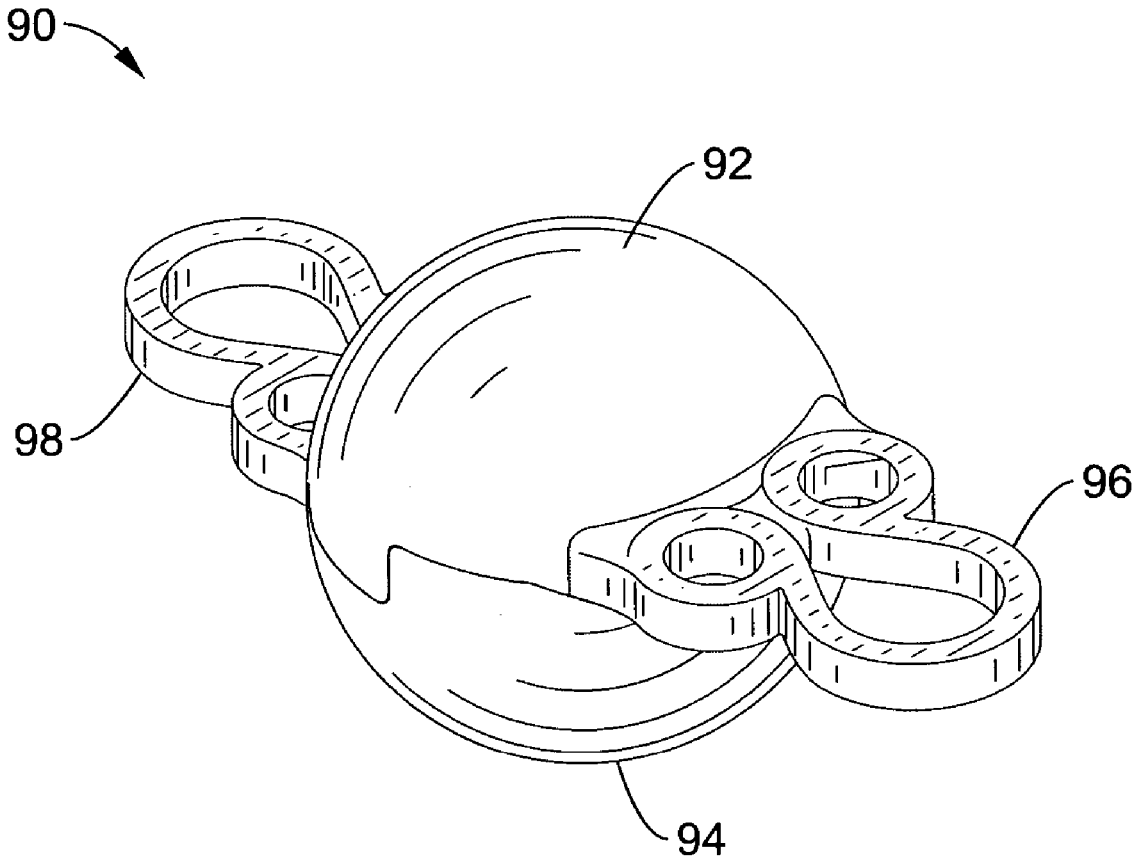
FIG. 7 illustrates a perspective view of another embodiment of a clasp assembly in the locked configuration having a spherical shape and elongated eyelets.

FIG. 7 illustrates a perspective view of another embodiment of the invention in a locked configuration. Clasp 90 has top portion 92 and bottom portion 94 each in a semi-spherical configuration. Eyelets 96 and 98 are attached to top, bottom portions 92, 94 respectively and oriented on opposing sides. Eyelets 96, 98 are configured as three joined loops to provide additional area for attachment and extra surface area for gripping. With larger eyelets, the present invention can also be disengaged by pressing down on the eyelets with the index and middle finger, up on one of the sections with the thumb and then pinching between the separated sections. In an exemplary embodiment, clasp 90 is made of a material with non-magnetic properties such as sterling silver or bronze and has a diameter of about 8 mm to about 10 mm. Eyelets 96, 98 are each about 5 mm to about 6 mm long and about 6 mm wide. The total length of clasp 90 is about 18 mm to about 22 mm. Clasp 90 can also be plated with a precious metal such as gold or silver.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A clasp for securing two ends of an elongated item, the clasp comprising:

a first clasp member, said first clasp member having a first bore configured to receive a magnet, said first clasp member having a first interface surface circumscribing said first bore;

a second clasp member, said second clasp member having a second bore configured to receive a magnet, said second clasp member having a second interface surface circumscribing said second bore;

a first magnet positioned in said first bore and coupled to said first clasp member;

wherein said second clasp member is configured to be magnetically attracted to said first magnet;

wherein said first interface surface and said second interface surface have mating profiles; and wherein rotation of said first clasp member with respect to said second clasp member in a first direction decreases magnetic attractive forces between said first clasp member and said second clasp member and provides for separation of said clasp members;

wherein said first interface surface includes at least one cambered protrusion that mates with a complementary recess in said second interface surface;

wherein said first magnet has first and second ends; and wherein said first magnet is positioned within said first bore and securedly attached at said first end to said first clasp member; and a second magnet having first and second ends;

wherein said second magnet is positioned within said second bore and securedly attached at said first end to said second clasp member; and wherein said second end of said first magnet is positioned at or above the lowest point of said cambered protrusions on said first clasp member and said second end of said second magnet is positioned at or below the highest point of said cambered protrusions on said second clasp member.

2. A clasp for securing two ends of an elongated item, the clasp comprising:

a first clasp member, said first clasp member having a first bore configured to receive a magnet, said first clasp member having a first interface surface circumscribing said first bore;

a second clasp member, said second clasp member having a second bore configured to receive a magnet, said second clasp member having a second interface surface circumscribing said second bore;

a first magnet positioned in said first bore and coupled to said first clasp member;

wherein said second clasp member is configured to be magnetically attracted to said first magnet;

wherein said first interface surface and said second interface surface have mating profiles; and wherein rotation of said first clasp member with respect to said second clasp member in a first direction decreases magnetic attractive forces between said first clasp member and said second clasp member and provides for separation of said clasp members;

wherein said first interface surface includes at least one cambered protrusion that mates with a complementary recess in said second interface surface; and wherein said first interface surface includes three cambered protrusions that mate with complementary recesses between three cambered protrusions in said second interface surface.

3. A clasp as recited in claim 2, further comprising: at least one eyelet coupled to an outer surface of said first clasp member; and at least one eyelet coupled to an outer surface of said second clasp member.

4. A clasp as recited in claim 3:

wherein said first interface surface includes one or more cambered protrusions;

wherein said second interface surface includes one or more cambered protrusions;

wherein said number of cambered protrusions on said first and second interface surfaces are identical; and wherein the position of said cambered protrusions in said first interface surface relative to said first eyelet is identical to the position of said cambered protrusions in said second interface surface relative to said second eyelet.

5. A clasp as recited in claim 2, wherein said first and second interface surfaces include one or more stops configured to restrict rotation of said first clasp member with respect to said second clasp member.

6. A clasp as recited in claim 2, wherein said first and second clasp members comprise a material having no magnetic properties.

7. A clasp as recited in claim 2, wherein said first and second clasp members comprise a material selected from the group consisting of gold, silver, copper, bronze, aluminum, stainless steel and precious metals.

8. A clasp as recited in claim 2;

wherein said first magnet has first and second ends;

wherein said first magnet is positioned within said first bore and securedly attached at said first end to said first clasp member.

9. A clasp as recited in claim 8, further comprising:

a second magnet having first and second ends;

wherein said second magnet is positioned within said second bore and securedly attached at said first end to said second clasp member.

10. A clasp as recited in claim 9, wherein at least one of the magnets comprises a neodymium magnet.

11. A clasp as recited in claim 9, wherein said first and second magnets are coated with a precious metal.

12. A clasp as recited in claim 9, wherein said second end of said first magnet is positioned at or above the lowest point of said cambered protrusions on said first clasp member and said second end of said second magnet is positioned at or below the highest point of said cambered protrusions on said second clasp member.

13. A clasp as recited in claim 9, further comprising:

a tube securedly attached inside the bore of said first clasp member, said tube having an inside diameter slightly larger than the outside diameter of said first and second magnets;

wherein the length of said tube is sized to encompass at least a portion of both first and second magnets when said first interface surface contacts said second interface surface.

14. A clasp as recited in claim 13, wherein said tube comprises a material selected to redirect the magnetic flux toward a north-south polar axis of said first and second magnets.

15. A clasp as recited in claim 13, further comprising:

a first disc coupled between said first clasp member and said first magnet;

a second disc coupled between said second clasp member and said second magnet;

wherein said first and second discs and said tube form a chamber enclosing said first and second magnets when said first and second clasp members are joined.

16. A clasp as recited in claim 15, wherein said first and second discs and said tube comprise steel.

17. A clasp as recited in claim 16, wherein at least one of said magnets comprises a neodymium magnet.

18. A clasp for securing two ends of an elongated item, the clasp comprising:

a first clasp member having a first interface surface;

a second clasp member having a second interface surface;

means for magnetically securing said first clasp member to said second clasp member when said first interface surface is in contact with said second interface surface; and means for separating said first interface surface with respect to said second interface surface when said first member is rotated with respect to said second member, thereby releasing said means for magnetically securing said first clasp member to said second clasp member;

wherein said means for magnetically securing comprises:

a first magnet having first and second ends;

wherein said first magnet is securedly attached at said first end to the first clasp member; and a second magnet having first and second ends;

wherein said second magnet is securedly attached at said first end to the second clasp member;

wherein at least one of the magnets comprises a neodymium magnet;

wherein said first and second magnets are coated with gold or silver;

wherein said first interface surface comprises at least one cambered protrusion that mates with the same number of complementary recesses formed between cambered protrusions in the second interface surface;

wherein said second end of said first magnet is positioned at or above the lowest point of said cambered protrusions on said first clasp member; and wherein said second end of said second magnet is positioned at or below the highest point of said cambered protrusions on said second clasp member.

19. A clasp for securing two ends of an elongated item, the clasp comprising:

a first clasp member having a first interface surface;

a second clasp member having a second interface surface;

means for magnetically securing said first clasp member to said second clasp member when said first interface surface is in contact with said second interface surface;

means for separating said first interface surface with respect to said second interface surface when said first member is rotated with respect to said second member, thereby releasing said means for magnetically securing said first clasp member to said second clasp member;

wherein said means for magnetically securing comprises:

a first magnet having first and second ends;

wherein said first magnet is securedly attached at said first end to the first clasp member;

a second magnet having first and second ends;

wherein said second magnet is securedly attached at said first end to the second clasp member; and a tube securedly attached to said first clasp member, said tube having an inside diameter slightly larger than the outside diameter of said first and second magnets;

wherein the length of said tube is sized to encompass at least a portion of both said first and second magnets when said first interface surface is in contact with said second interface surface.

20. A clasp as recited in claim 19, wherein said tube comprises a material selected to redirect the magnetic flux toward a north-south polar axis of said first and second magnets.

21. A clasp as recited in claim 20, further comprising:

a first disc coupled between said first clasp member and said first magnet;

a second disc coupled between said second clasp member and said second magnet;

wherein said first and second discs and said tube form a chamber enclosing said first and second magnets when said first and second clasp members are joined.

22. A clasp as recited in claim 21, wherein said first and second discs and said tube comprise a material having magnetic properties.

23. A clasp for securing two ends of an elongated item, the clasp comprising:

a first clasp member, said first clasp member having a first bore configured to receive a magnet, said first clasp member having a first interface surface circumscribing said first bore;

a second clasp member, said second clasp member having a second bore configured to receive a magnet, said second clasp member having a second interface surface circumscribing said second bore;

a first magnet positioned in said first bore and coupled to said first clasp member;

a second magnet positioned in said second bore and coupled to said second clasp member;

at least one eyelet coupled to an outer surface of said first clasp member; and at least one eyelet coupled to an outer surface of said second clasp member;

wherein said second magnet is configured to be magnetically attracted to said first magnet;

wherein said first interface surface and said second interface surface have mating profiles;

wherein rotation of said first clasp member with respect to said second clasp member in a first direction decreases magnetic attractive forces between said first clasp member and said second clasp member and provides for separation of said clasp members;

wherein said first interface surface includes one or more cambered protrusions;

wherein said second interface surface includes one or more cambered protrusions;

wherein said number of cambered protrusions on said first and second interface surfaces are identical; and wherein the position of said cambered protrusions in said first interface surface relative to said first eyelet is identical to the position of said cambered protrusions in said second interface surface relative to said second eyelet.

24. A clasp as recited in claim 23, wherein said first interface surface includes three cambered protrusions that mate with complementary recesses between three cambered protrusions in said second interface surface.

25. A clasp as recited in claim 24, wherein said first and second interface surfaces include one or more stops configured to restrict rotation of said first clasp member with respect to said second clasp member.

26. A clasp for securing two ends of an elongated item, the clasp comprising:

a first clasp member, said first clasp member having a first bore configured to receive a magnet, said first clasp member having a first interface surface circumscribing said first bore;

a second clasp member, said second clasp member having a second bore configured to receive a magnet, said second clasp member having a second interface surface circumscribing said second bore;

a first magnet positioned in said first bore and coupled to said first clasp member;

a second magnet positioned in said second bore and coupled to said second clasp member; and a tube securedly attached inside the bore of said first clasp member, said tube having an inside diameter slightly larger than the outside diameter of said first and second magnets;

wherein said second magnet is configured to be magnetically attracted to said first magnet;

wherein said first interface surface and said second interface surface have mating profiles;

wherein rotation of said first clasp member with respect to said second clasp member in a first direction decreases magnetic attractive forces between said first clasp member and said second clasp member and provides for separation of said clasp members; and wherein the length of said tube is sized to encompass at least a portion of both first and second magnets when said first interface surface contacts said second interface surface.

27. A clasp as recited in claim 26, wherein said tube comprises a material selected to redirect the magnetic flux toward a north-south polar axis of said first and second magnets.

28. A clasp as recited in claim 26, further comprising:

a first disc coupled between said first clasp member and said first magnet;

a second disc coupled between said second clasp member and said second magnet;

wherein said first and second discs and said tube form a chamber enclosing said first and second magnets when said first and second clasp members are joined.

29. A clasp as recited in claim 28, wherein said first and second discs and said tube comprise steel.

30. A clasp for securing two ends of an elongated item, the clasp comprising:

a first clasp member, said first clasp member having a first bore configured to receive a magnet, said first clasp member having a first interface surface circumscribing said first bore;

a second clasp member, said second clasp member having a second bore configured to receive a magnet, said second clasp member having a second interface surface circumscribing said second bore;

a first magnet positioned in said first bore and coupled to said first clasp member;

wherein said second clasp member is configured to be magnetically attracted to said first magnet;

wherein said first interface surface and said second interface surface have mating profiles; and wherein rotation of said first clasp member with respect to said second clasp member in a first direction decreases magnetic attractive forces between said first clasp member and said second clasp member and provides for separation of said clasp members;

wherein said first interface surface includes at least one cambered protrusion that mates with a complementary recess in said second interface surface;

wherein said first magnet has first and second ends; and wherein said first magnet is positioned within said first bore and securedly attached at said first end to said first clasp member;

a second magnet having first and second ends;

wherein said second magnet is positioned within said second bore and securedly attached at said first end to said second clasp member; and a tube securedly attached inside the bore of said first clasp member, said tube having an inside diameter slightly larger than the outside diameter of said first and second magnets;

wherein the length of said tube is sized to encompass at least a portion of both first and second magnets when said first interface surface contacts said second interface surface.

31. A clasp as recited in claim 30, wherein said tube comprises a material selected to redirect the magnetic flux toward a north-south polar axis of said first and second magnets.

32. A clasp as recited in claim 30, further comprising:

a first disc coupled between said first clasp member and said first magnet;

a second disc coupled between said second clasp member and said second magnet;

wherein said first and second discs and said tube form a chamber enclosing said first and second magnets when said first and second clasp members are joined.

33. A clasp as recited in claim 32, wherein said first and second discs and said tube comprise steel.

34. A clasp as recited in claim 33, wherein at least one of said magnets comprises a neodymium magnet.

* * * * *